US009318796B2

(12) United States Patent
Hsu et al.

(10) Patent No.: US 9,318,796 B2
(45) Date of Patent: Apr. 19, 2016

(54) MULTIBAND ANTENNA

(71) Applicant: Chiun Mai Communication Systems, Inc., New Taipei (TW)

(72) Inventors: Cho-Kang Hsu, New Taipei (TW); Che-Yen Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 208 days.

(21) Appl. No.: 14/014,623

(22) Filed: Aug. 30, 2013

(65) Prior Publication Data

US 2014/0313083 A1 Oct. 23, 2014

(30) Foreign Application Priority Data

Apr. 19, 2013 (TW) ..... 102113874 A

(51) Int. Cl.

| | |
|---|---|
| ***H01Q 1/24*** | (2006.01) |
| ***H01Q 9/04*** | (2006.01) |
| ***H01Q 21/28*** | (2006.01) |
| ***H01Q 5/371*** | (2015.01) |

(52) U.S. Cl.

CPC ..... *H01Q 1/243* (2013.01); *H01Q 5/371* (2015.01); *H01Q 9/0421* (2013.01); *H01Q 21/28* (2013.01)

(58) Field of Classification Search

CPC ..... H01Q 5/371; H01Q 1/243; H01Q 21/28; H01Q 9/0421; H01Q 5/0062; H01Q 5/378; H01Q 5/385; H01Q 5/392; H01Q 5/00

See application file for complete search history.

(56) References Cited

U.S. PATENT DOCUMENTS

| | | | | |
|---|---|---|---|---|
| 8,072,389 | B2 * | 12/2011 | Chang et al. | 343/846 |
| 2008/0129630 | A1 * | 6/2008 | Baliarda et al. | 343/793 |

* cited by examiner

*Primary Examiner* — Michael C Wimer
*Assistant Examiner* — Noel Maldonado
(74) *Attorney, Agent, or Firm* — Novak Druce Connolly Bove + Quigg LLP

(57) ABSTRACT

A multiband antenna includes a feed end, a first ground end, a second ground end, a ground path, parasitic member, a first resonating member, and a second resonating member. The ground path is connected between the feed end and the first ground end. The first resonating member operates at a low frequency resonating mode. The second resonating member operates at a high frequency resonating mode. The second resonating member includes a first bent portion and a second bent portion. The first bent portion is coupled with the parasitic member to widen a bandwidth of the second resonating member at the high frequency resonating mode. The second bent portion is coupled with the first resonating member to reduce an electrical length of the first resonating member.

15 Claims, 2 Drawing Sheets

MULTIBAND ANTENNA

BACKGROUND

1. Technical Field

The disclosure generally relates to multiband antennas, and particularly to a compact multiband antenna.

2. Description of Related Art

In wireless communication devices such as mobile phones and personal digital assistants, antenna devices used to transmit and exchange radio data by transmitting and receiving electromagnetic waves are considered as one of the most important components.

To realize the wireless communication devices suitable for different communication systems, wideband antennas are used to allow transmission and reception of multiple frequency bands for different communication systems. However, most wideband antennas are large and have complicated structures, making it difficult to miniaturize the portable electronic devices.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
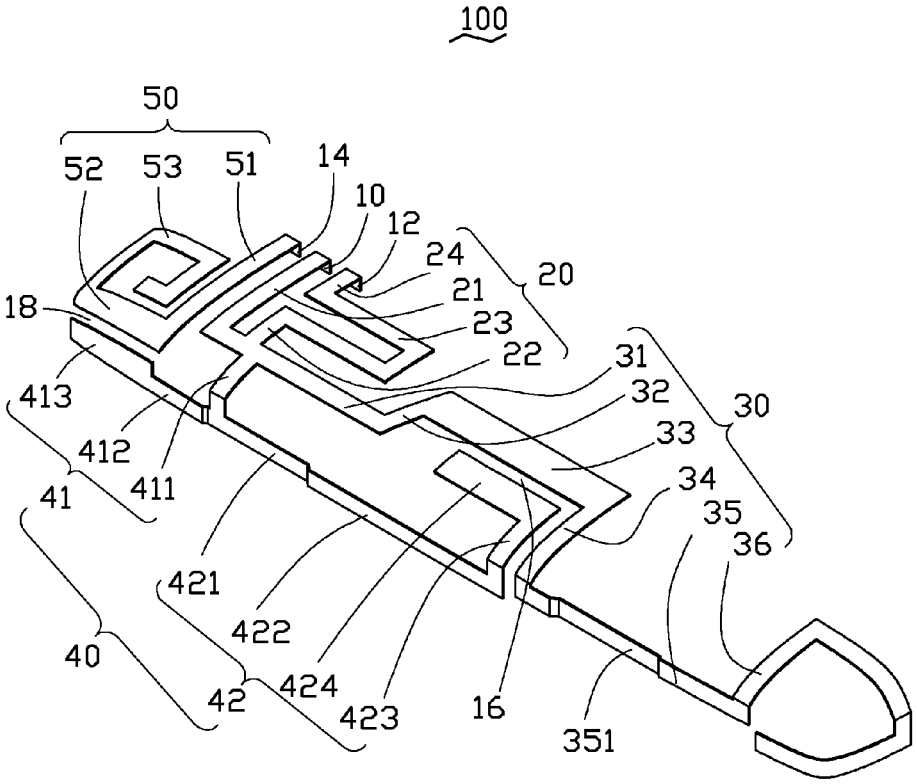
FIG. 1 is a schematic view of a multiband antenna, according to an exemplary embodiment of the disclosure.

FIG. 1 is a schematic view of a multiband antenna 100, according to an exemplary embodiment of the disclosure. The multiband antenna 100 is used in a wireless communication device such as mobile phone and configured to transmit and receive radio signals.

The multiband antenna 100 includes a feed end 10, a first ground end 12, a second ground end 14, a ground path 20, a first resonating element 30, a second resonating element 40, and a parasitic element 50.

The feed end 10 is substantially a strip-shaped sheet configured to electronically connect to a signal feed point (not shown) of a circuit board of the wireless communication device and feed current.

The first ground end 12 and the second ground end 14 are substantially similar to the feed end 10 being both strip-shaped sheets. The first ground end 12 and the second ground end 14 are positioned at two sides of the feed end 10 and are spaced from and parallel to the feed end 10.

The ground path 20 is connected between the feed end 10 and the first ground end 12. The ground path 20 includes a first connecting section 21, a second connecting section 22, a third connecting section 23, and a fourth connecting section 24 connected in that order. The first connecting section 21 is substantially L-shaped. One end of the first connecting section 21 is connected to the feed end 10. Another end of the first connecting section 21 is perpendicularly connected to the second connecting section 22. The second connecting section 22 is a strip-shaped sheet extending from the first connecting section 21 and connecting to one end of the third connecting section 23. The third connecting section 23 is substantially U-shaped. One end of the fourth connecting section 24 is connected to the first ground end 12. Another end of the fourth connecting section 24 is connected to anther end of the third connecting section 23 opposite to the second connecting section 22. The fourth connecting section 24 is collinear with the second connecting section 22.

The first resonating member 30 includes a first combining section 31, a second combining section 32, a third combining section 33, a fourth combining section 34, a fifth combining section 35, and a sixth combining section 36 connected to each other in that order.

The first combining section 31 perpendicularly extends from an end of the second connecting section 22. An angle between the first combining section 31 and the second combining section 32 is slightly greater than 90 degrees such as 95 degrees to 100 degrees. The third combining section 33 is parallel to the first combining section 31. The fourth combining section 34 is an arcuate sheet connected between the fourth combining section 34 and the fifth combining section 35. The fifth combining section 35 is a bent sheet including a recessed portion 351. The fifth combining section 35 is connected between the fourth combining section 34 and the sixth combining section 36. The sixth combining section 36 is a curved sheet. One end of the sixth combining section 36 is connected to the fifth combining section 35. Another end of the sixth combining section 36 is close to the combining section 35. The first combining section 31, the second combining section 32, the third combining section 33, the fourth combining section 34 are positioned at a plane substantially perpendicular to the fifth combining section 35.

The second resonating member 40 includes a first bent portion 41 and a second bent portion 42.

The first bent portion 41 includes a first bent section 411, a second bent section 412, and a third bent section 413. The first bent section 411 is substantially L-shaped. One end of the first bent section 411 is perpendicularly connected to the first combining section 31. Another end of the first bent section 411 is connected to the second bent section 412. The third bent section 413 extends from an end of the second bent section 411. A width of the third bent section 413 is slightly greater than a width of the second bent section 412.

The second bent portion 42 includes a fourth bent section 421, a fifth bent section 422, a sixth bent section 423, and a seventh bent section 424. The fourth bent section 421 extends from the first bent section 411 along a direction opposite to the second bent section 412. The fifth bent section 422 extends from the fourth bent section 421 and protrudes from the fourth bent section 421. The sixth bent section 423 is substantially L-shaped. Two ends of the sixth bent section 423 are respectively connected to the fifth bent section 422 and the seventh bent section 424. The seventh bent section 424 is parallel to the third combining section 33 and defines a first coupling gap 16. The sixth bent section 423 and the seventh bent section 424 are positioned at a plane substantially perpendicular to the fourth bent section 421 and the fifth bent section 422.

The parasitic element 50 includes a first parasitic section 51, a second parasitic section 52, and a third parasitic section 53 connected in that order. The first parasitic section 51 extends from the second ground end 14. The second parasitic section 52 is perpendicularly connected to the first parasitic section 51 and parallel to the third bent section 413. A second coupling gap is defined between the first parasitic section 51 and the third bent section 413. The third parasitic section 53 is substantially a rectangular frame positioned at one side of the first parasitic section 51.

In use, the first resonating member 30 operates at a first frequency band of about 824 MHz-960 MHz. In addition, the second bent portion 42 is coupled with the first resonating member 30 to improve impedance matching with the first resonating member 30 and decrease a resonating frequency of the first resonating member 30 so that dimensions of the first resonating member 30 are decreased to form a compact multiband antenna 100. Dimensions of the first coupling gap 16 can be changed to adjust a coupling state between the second bent portion 42 and the first resonating member 30.

Figure 2:
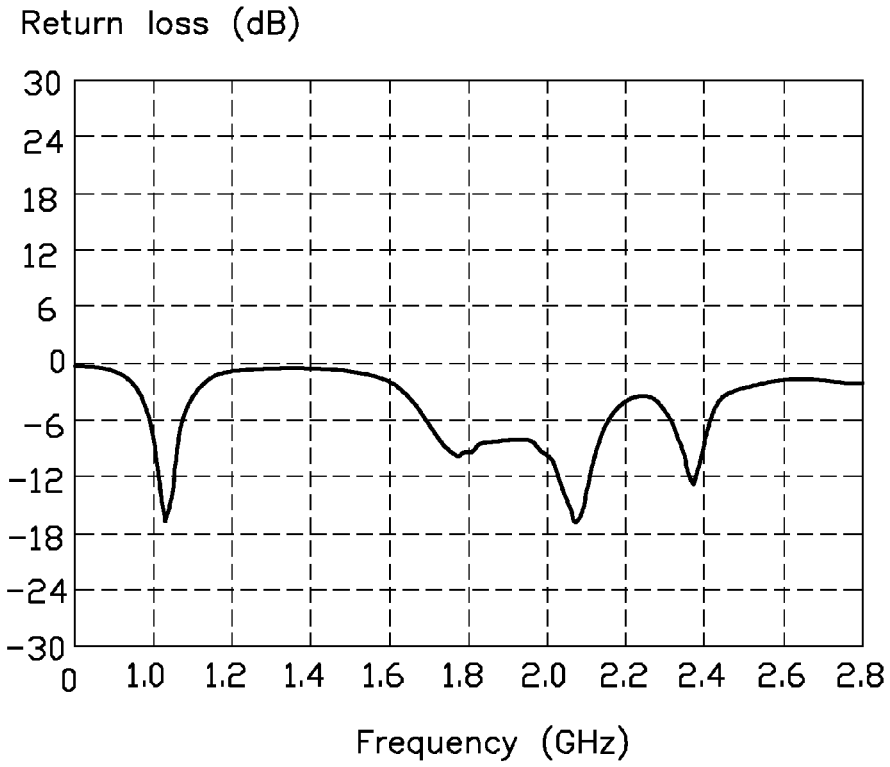
FIG. 2 is a diagram showing return loss measurements of the multiband antenna of FIG. 1.

The second resonating member 40 operates at a second frequency band of about 1710 MHz-2170 MHz. The parasitic member 50 is coupled with the first bent section 41 to improve impedance matching with the second resonating member 40. Dimensions of the second coupling gap 18 can be changed to adjust a coupling state between the parasitic member 50 and the first bent section 41. In addition, referring to FIG. 2, the multiband antenna 100 can satisfy design requirements for GSM/DCS/PCS/WCDMA frequency bands.

The first resonating member 30 achieves the lower bandwidth and also is coupled with the second resonating member 40 to reduce an electric length of the first resonating member 30. In addition, the second resonating member 40 is coupled with the parasitic member 50 to widen the bandwidth of the multiband antenna 100.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A multiband antenna, comprising:

a feed end;

a first ground end;

a second ground end; a ground path, the ground path connected between the feed end and the first ground end;

a parasitic member extending from the second ground end;

a first resonating member connected to the ground path, the first resonating member for operating at a first frequency resonating mode;

a second resonating member connected to the ground path, the second resonating member for operating at a second frequency resonating mode, the second resonating member comprising:

a first bent portion, the first bent portion coupled with the parasitic member to widen a bandwidth of the second resonating member at the high frequency resonating mode; and a second bent portion, the second bent portion coupled with the first resonating member to reduce an electrical length of the first resonating member;

wherein the second bent portion extends from the first bent portion along an opposite direction, the first resonating member and the second bent portion define a first coupling gap; the first bent portion and the parasitic member define a second coupling gap.

2. The multiband antenna of claim 1, wherein the ground path comprises a first connecting section, a second connecting section, a third connecting section, and a fourth connecting section connected in order, the first connecting section is substantially L-shaped, one end of the first connecting section is connected to the feed end, another end of the first connecting section is perpendicularly connected to the second connecting section, the second connecting section is a strip-shaped sheet extending from the first connecting section toward to the third connecting section and connecting to one end of the third connecting section, the third connecting section is substantially U-shaped, one end of the fourth connecting section is connected to the first ground end, another end of the fourth connecting section is connected to anther end of the third connecting section opposite to the second connecting section, the fourth connecting section is collinear with the second connecting section.

3. The multiband antenna of claim 2, wherein the first resonating member comprises a first combining section, a second combining section, a third combining section, a fourth combining section, a fifth combining section and a sixth combining section connected in order.

4. The multiband antenna of claim 3, wherein the first combining section perpendicularly extends from an end of the second connecting section; an angle between the first combining section and the second combining section is slightly greater than 90 degrees, the third combining section is parallel to the first combining section, the fourth combining section is an arcuate sheet connected between the fourth combining section and the fifth combining section, the fifth combining section is a bent sheet including a recessed portion, the fifth combining section is connected between the fourth combining section and the sixth combining section, the sixth combining section is a curved sheet, one end of the sixth combining section is connected to the fifth combining section, another end of the sixth combining section is closed to the combining section.

5. The multiband antenna of claim 4, wherein the first combining section, the second combining section, the third combining section, the fourth combining section are positioned at a plane substantially perpendicular to the fifth combining section.

6. The multiband antenna of claim 5, wherein the first bent portion comprises a first bent section, a second bent section, and a third bent section, the first bent section is substantially L-shaped, one end of the first bent section is perpendicularly connected to the first combining section, another end of the first bent section is connected to the second bent section, the third bent section extends from an end of the second bent section, a width of the third bent section is slightly wider than that of the second bent section.

7. The multiband antenna of claim 6, wherein the second bent portion comprises a fourth bent section, a fifth bent section, a sixth bent section, and a seventh bent section, the fourth bent section extends from the first bent section along a direction opposite to the second bent section, the fifth bent section extends from the fourth bent section and protrudes from the fourth bent section, the sixth bent section is substantially L-shaped, two ends of the sixth bent section are respectively connected to the fifth bent section and the seventh bent section, the seventh bent section is parallel to the third combining section, the sixth bent section and the seventh bent section are positioned at a plane substantially perpendicular to the fourth bent section and the fifth bent section.

8. The multiband antenna of claim 7, wherein the parasitic member comprise a first parasitic section, a second parasitic section, and a third parasitic section connected in order, the first parasitic section extends from the second ground end, the second parasitic section is perpendicularly connected to the first parasitic section and parallel to the third bent section, the third parasitic section is substantially a rectangular frame positioned at one side of the first parasitic section.

9. A multiband antenna, comprising:

a feed end;

a first ground end;

a second ground end extending from the second ground end; a ground path, the ground path connected between the feed end and the first ground end;

a parasitic member;

a first resonating member connected to the ground path, the first resonating member for operating at a first frequency resonating mode;

a second resonating member connected to the ground path, the second resonating member for operating at a second frequency resonating mode, the second resonating member comprising:

a first bent portion, the first bent portion coupled with the parasitic member to widen a bandwidth of the second resonating member at the high frequency resonating mode, the first bent portion comprising:

a substantially L-shaped first bent section;

a second bent section; and a third bent section, one end of the first bent section perpendicularly connected to the first resonating member, another end of the first bent section connected to the second bent section, the third bent section extending from an end of the second bent section;

a second bent portion, the second bent portion is coupled with the first resonating member to reduce an electrical length of the first resonating member;

wherein the second bent portion extends from the first bent portion along an opposite direction, the first resonating member and the second bent portion define a first coupling gap; the first bent portion and the parasitic member define a second coupling gap.

10. The multiband antenna of claim 9, wherein the second bent portion comprises a fourth bent section, a fifth bent section, a sixth bent section, and a seventh bent section, the fourth bent section extends from the first bent section along a direction opposite to the second bent section, the fifth bent section extends from the fourth bent section and protrudes from the fourth bent section, the sixth bent section is substantially L-shaped, two ends of the sixth bent section are respectively connected to the fifth bent section and the seventh bent section, the seventh bent section is parallel to the third combining section, the sixth bent section and the seventh bent section are positioned at a plane substantially perpendicular to the fourth bent section and the fifth bent section.

11. The multiband antenna of claim 9, wherein the parasitic member comprise a first parasitic section, a second parasitic section, and a third parasitic section connected in order, the first parasitic section extends from the second ground end, the second parasitic section is perpendicularly connected to the first parasitic section and parallel to the third bent section, the third parasitic section is substantially a rectangular frame positioned at one side of the first parasitic section.

12. The multiband antenna of claim 9, wherein the ground path comprises a first connecting section, a second connecting section, a third connecting section, and a fourth connecting section connected in order, the first connecting section is substantially L-shaped, one end of the first connecting section is connected to the feed end, another end of the first connecting section is perpendicularly connected to the second connecting section, the second connecting section is a strip-shaped sheet extending from the first connecting section toward to the third connecting section and connecting to one end of the third connecting section, the third connecting section is substantially U-shaped, one end of the fourth connecting section is connected to the first ground end, another end of the fourth connecting section is connected to anther end of the third connecting section opposite to the second connecting section, the fourth connecting section is collinear with the second connecting section.

13. The multiband antenna of claim 9, wherein the first resonating member comprises a first combining section, a second combining section, a third combining section, a fourth combining section, a fifth combining section and a sixth combining section connected in order.

14. The multiband antenna of claim 13, wherein the first combining section perpendicularly extends from an end of the second connecting section; an angle between the first combining section and the second combining section is slightly greater than 90 degrees, the third combining section is parallel to the first combining section, the fourth combining section is an arcuate sheet connected between the fourth combining section and the fifth combining section, the fifth combining section is a bent sheet including a recessed portion, the fifth combining section is connected between the fourth combining section and the sixth combining section, the sixth combining section is a curved sheet, one end of the sixth combining section is connected to the fifth combining section, another end of the sixth combining section is closed to the combining section.

15. The multiband antenna of claim 14, wherein the first combining section, the second combining section, the third combining section, the fourth combining section are positioned at a plane substantially perpendicular to the fifth combining section.

* * * * *